US006447624B2

(12) United States Patent
Nonomura et al.

(10) Patent No.: US 6,447,624 B2
(45) Date of Patent: Sep. 10, 2002

(54) MANUFACTURING PROCESS OF NICKEL-BASED ALLOY HAVING IMPROVED HOT SULFIDATION-CORROSION RESISTANCE

(75) Inventors: Toshiaki Nonomura, Yasugi (JP); Takehiro Ohno, Kuwana (JP); Toshihiro Uehara, Yonago (JP); Hiroshi Yakuwa, Fujisawa (JP); Matsuho Miyasaka, Yokohama (JP); Shuhei Nakahama, Kisarazu (JP); Shigeru Sawada, Tokyo (JP)

(73) Assignees: Hitachi Metals, Ltd., Tokyo (JP); Ebara Corporation, Tokyo (JP)

( * ) Notice: Subject to any disclaimer, the term of this patent is extended or adjusted under 35 U.S.C. 154(b) by 0 days.

(21) Appl. No.: 09/825,948

(22) Filed: Apr. 5, 2001

(30) Foreign Application Priority Data

Apr. 11, 2000 (JP) ..... 2000-108921

(51) Int. Cl.[7] ..... C22F 1/10
(52) U.S. Cl. ..... 148/677; 148/428; 148/675
(58) Field of Search ..... 148/677, 675, 148/428

(56) References Cited

U.S. PATENT DOCUMENTS

| | | | | |
|---|---|---|---|---|
| 3,615,906 A | * | 10/1971 | Vanwanderham | 148/12.7 |
| 3,660,177 A | * | 5/1972 | Brown et al. | 148/11.5 |
| 3,898,109 A | | 8/1975 | Shaw | 148/162 |
| 4,039,330 A | | 8/1977 | Shaw | 75/171 |
| 4,121,950 A | | 10/1978 | Guimier et al. | 148/12.7 |
| 4,207,098 A | | 6/1980 | Shaw | 75/171 |
| 4,479,293 A | * | 10/1984 | Miller et al. | 29/156.8 |
| 4,624,716 A | * | 11/1986 | Noel et al. | 148/12.7 |
| 5,328,659 A | * | 7/1994 | Tillman et al. | 420/448 |
| 5,527,403 A | | 6/1996 | Schirra et al. | 148/675 |
| 5,900,078 A | | 5/1999 | Yakuwa et al. | 148/410 |
| 6,132,535 A | * | 10/2000 | Okada et al. | 148/677 |
| 6,146,478 A | * | 11/2000 | Balbach et al. | 148/707 |

FOREIGN PATENT DOCUMENTS

| | | | |
|---|---|---|---|
| EP | 0 302 302 | 2/1989 | C22C/19/05 |
| EP | 0 361 524 B1 | 5/1994 | |
| EP | 0 709 477 | 5/1996 | C22C/19/05 |

* cited by examiner

*Primary Examiner*—Roy King
*Assistant Examiner*—Andrew Wessman
(74) *Attorney, Agent, or Firm*—Sughrue Mion, PLLC

(57) ABSTRACT

A manufacturing method, particularly a heat treatment method of a Ni-based alloy having sulfidation-corrosion resistance used for component members of corrosion-resistant high-temperature equipment, that is, Waspaloy (a trademark of United Technologies) or its improved Ni-based alloy wherein the high temperature sulfidation-corrosion resistance of the alloy can be improved while maintaining hot strength properties is disclosed. A Ni-based alloy used for the method consists essentially of 0.005 to 0.1% C, 18 to 21% Cr, 12 to 15% Co, 3.5 to 5.0% Mo, not more than 3.25% Ti and 1.2 to 4.0% Al (expressed in mass percentage), with the balance substantially comprising Ni. In the manufacturing method of a Ni-based alloy having improved sulfidation-corrosion resistance, the alloy is, after solution heat treatment, subjected to stabilizing treatment at a temperature not lower than 860° C. and not higher than 920° C. for 1 to 16 hours, and aging treatment at a temperature not lower than 680° C. and not higher than 760° C. for 4 to 48 hours.

6 Claims, 2 Drawing Sheets

MANUFACTURING PROCESS OF NICKEL-BASED ALLOY HAVING IMPROVED HOT SULFIDATION-CORROSION RESISTANCE

BACKGROUND OF THE INVENTION

1. Field of the Invention

The present invention relates to a manufacturing method of a heat-resistant alloy having excellent hot sulfidation-corrosion resistance suitable for use in apparatuses used in high temperature corrosion environments, particularly in sulfur-corrosion environment containing $H_2S$, $SO_2$, etc., such as expander turbines utilizing the energy recovered from exhaust gas from fluid catalytic cracking unit in a petroleum refining system, for example.

2. Description of the Related Art

Heat-resistant nickel-based alloys having excellent strength and corrosion resistance at elevated temperature have heretofore been widely used for members exposed to high temperatures, such as expander turbine rotors. A typical example of such alloys is what is known as Waspaloy (a registered trademark of United Technologies).

Heat-resistant nickel-based alloys used for members exposed to elevated temperatures usually gain their high temperature strength through the precipitation strengthening of intermetallic compounds called the γ' phase. Since the γ' phase has $Ni_3(Al, Ti)$ as its basic composition, Al and Ti are normally added to these alloys.

In high-temperature equipment exposed to a combustion-gas atmosphere, such as boilers, on the other hand, the so-called "hot corrosion" phenomenon involving molten salts such as sulfates, V, Cl, etc., is known. It is reported that sulfidation corrosion caused by the direct reactions of gases not involving molten salts with metals occurs with nickel-based alloys at approximately 700° C. or higher. This phenomenon is attributable to the formation of a liquid phase of Ni—$Ni_3S_2$ eutectics.

In order to accomplish energy conservation in oil refineries, on the other hand, a system for recovering energy in the exhaust gas generated from the fluid catalytic cracking unit has been developed. When Waspaloy, a typical Ni-based superalloy, was used for gas-expander turbine blades in such equipment, sulfur corrosion occurred at the roots of the rotor blades though it was used in a temperature region far lower than the temperature heretofore considered critical.

Closer scrutiny of this phenomenon revealed that although corrosion developed along grain boundaries, no molten salts were present at corroded areas, indicating that the corrosion was caused by the direct reactions of the metal with gases. Such an intergranular sulfidation corrosion of a Ni-based superalloy in a sulfur-laden gas environment containing no molten salts in a temperature region lower than the eutectic point of Ni—$Ni_3S_2$ has been scarcely observed in the past.

To solve this problem, the inventors of U.S. Pat. No. 5,900,078 issued May 4, 1999 studied in detail the effects of alloy elements on the sulfidation behavior of Waspaloy in a sulfur-laden gas environment in a temperature region lower than the eutectic point of Ni—$Ni_3S_2$, and elucidated that the sulfidation layer in the alloy including grain boundaries is enriched in Ti, Al and Mo contained in the alloy, and that the Ti and Al contents of the alloy have a marked effect on the sulfidation-corrosion resistance of the alloy.

As a result, a hot sulfidation-corrosion-resistant Ni-based alloy containing 12 to 15% Co, 18 to 21% Cr, 3.5 to 5% Mo, 0.02 to 0.1% C, not more than 2.75% Ti and not less than 1.6% Al, with the balance substantially comprising Ni, excluding impurities, has been proposed, as disclosed in U.S. Pat. No. 5,900,078.

The alloy disclosed in U.S. Pat. No. 5,900,078 has attracted trade attention as a heat-resistant Ni alloy whose hot sulfidation-corrosion resistance has been dramatically improved by reducing the Ti content and increasing the Al content among the known addition elements of Waspaloy.

The present inventor et al., however, made clear after further study of the alloy that the sulfidation-corrosion resistance, particularly corrosion resistance at the alloy grain boundaries, that is, intergranular sulfidation-corrosion resistance of even the alloy having improved hot sulfidation-corrosion resistance, as disclosed in U.S. Pat. No. 5,900,078 could be changed if manufactured with difference methods. The same hold true with Waspaloy that has been widely known.

Since heat treatment conditions for these heat-resistant Ni alloys have often been determined, placing emphasis mainly upon strength characteristics and hot workability, the resulting alloys have not necessarily shown good hot sulfidation-corrosion resistance.

SUMMARY OF THE INVENTION

It is therefore an object of the present invention to provide a manufacturing method, particularly a heat treatment method for improving the sulfidation-corrosion resistance of the sulfidation-corrosion-resistant Ni-based alloy disclosed in U.S. Pat. No. 5,900,078 and other Ni-based alloys used for members of corrosion-resistant high-temperature equipment while maintaining the same high-temperature strength characteristics as those of conventional alloys.

After studying the intergranular sulfidation-corrosion characteristics of the hot sulfidation-corrosion resistant Ni-based alloy disclosed in U.S. Pat. No. 5,900,078 and Waspaloy, which were subjected to various heat treatment processes, the present inventor et al. discovered that grain boundaries are corroded because carbides chiefly consisting of Cr are precipitated in the grain boundaries, causing Cr to reduce in the vicinity of grain boundaries, and Cr-depleted zones to be formed along the grain boundaries. Consequently, the present inventor et al. have conceived the present invention based on the assumption that sulfidation corrosion at grain boundaries can be controlled by inhibiting the formation of Cr-depleted zones at the grain boundaries.

That is, the present invention is a manufacturing method of a Ni-based alloy containing 0.005 to 0.1% C, 18 to 21% Cr, 12 to 15% Co, 3.5 to 5.0% Mo, not more than 3.25% Ti, and 1.2 to 4.0% Al in mass percent, with the balance substantially consisting of Ni, and a manufacturing method of a Ni-based alloy having improved sulfidation-corrosion resistance which is, after solid solution heat treatment, subjected to stabilizing treatment for 1 to 16 hours at not lower than 860° C. and not higher than 920° C., and aging treatment for 4 to 48 hours at not lower than 680° C. and not higher than 760° C.

More preferably, the present invention is a manufacturing method of a Ni-based alloy having improved sulfidation-corrosion resistance which is subjected to secondary aging treatment for not less than 8 hours at not lower than 620° C. and not higher than an aging treatment temperature minus 20° C.

The present invention is a manufacturing method of a Ni-based alloy having improved sulfidation-corrosion resistance whose desirable alloy composition is Ti: not more than 2.75%, Al: 1.6 to 4.0% in mass percent, and more preferably any one type of B: not more than 0.01%, or Zr: not more than 0.1% in mass percent.

DETAILED DESCRIPTION OF THE PREFERRED EMBODIMENTS

Figure 1:
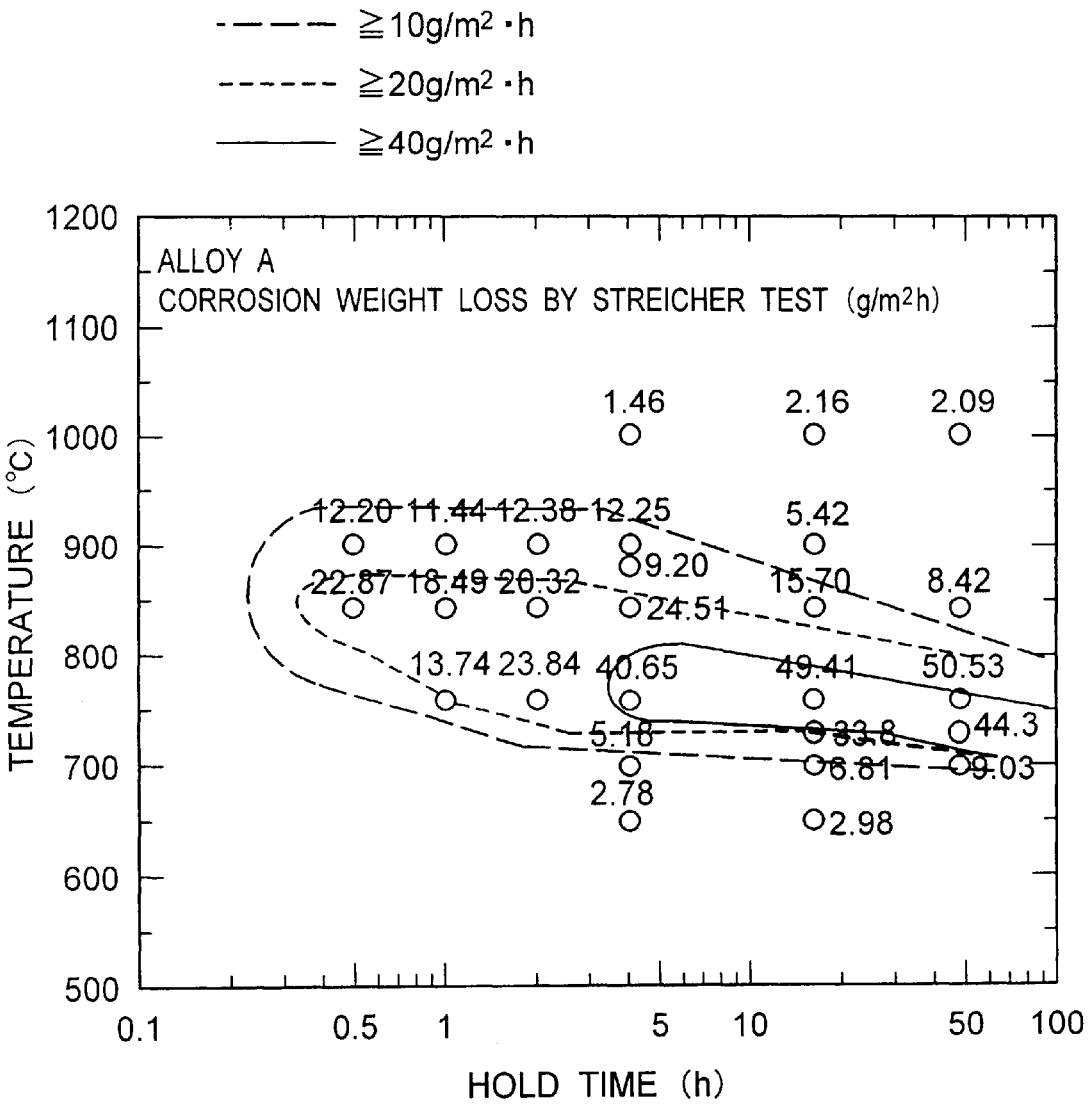
FIG. 1 shows a temperature-time-intergranular corrosion sensitivity curve in the Streicher test and FIGS. 2(A) and (B) are cross-sectional micrographs of specimens attacked by sulfidation corrosion under stress load condition.

The present invention was made based on the conception that sulfidation corrosion along grain boundaries can be controlled by inhibiting the formation of Cr-depleted zones along the grain boundaries; the conception was derived from the observation results reached during the study of the intergranular sulfidation-corrosion characteristics of a hot sulfidation-corrosion-resistant Ni-based alloy disclosed in U.S. Pat. No. 5,900,078 and Waspaloy that grain boundaries are corroded because Cr-depleted zones are formed along the grain boundaries as carbides chiefly consisting of Cr are precipitated in the grain boundaries.

In the following, the present invention will be described in detail.

The most remarkable feature of the present invention is the method of precipitating the Cr carbides transformed into solid solutions during solid solution heat treatment as much as possible in grain boundaries during the subsequent stabilizing treatment and recovering Cr-depleted zones through diffusion, thereby inhibiting the re-precipitation of Cr carbides in grain boundaries and the formation of the Cr-depleted zones during the subsequent aging (age hardening) treatment.

More specifically, the formation of Cr-depleted zones in the vicinity of alloy grain boundaries is inhibited by setting the temperature and time of stabilizing treatment after solution heat treatment to conditions under which Cr carbides can be precipitated in the, grain boundaries and Cr-depleted zones can be recovered along the grain boundaries, and setting the temperature of aging (age hardening) treatment to a temperature at which Cr carbides are hard to precipitate in alloy grain boundaries.

That is, Cr carbides often tend to be precipitated, thereby leaving Cr-depleted zones in the neighborhood of grain boundaries and aggravating the sulfidation-corrosion resistance of the alloy propensity during stabilizing treatment and aging (age hardening) treatment that are normally conducted on Waspaloy and other alloys, as will be described in the embodiments. The simplest way to avoid this is to subject the alloy to heat treatment at a temperature at which Cr carbides are not precipitated. In order to attain stabilized creep properties and adequate strength, on the other hand, stabilizing treatment and aging (age hardening) treatment to precipitate the γ' phase and control its shape are necessary, and precipitation of Cr carbides is inevitable during these treatments.

The first key point of the present invention is positively precipitating Cr carbides by setting stabilizing temperature to a temperature higher than the normal level, and causing Cr to diffuse into once-formed Cr-depleted zones because the stabilizing treatment is set to a temperature and time enough to initiate Cr diffusion, thereby recovering Cr-depleted zones.

By recovering Cr-depleted zones during stabilizing treatment and causing as much Cr carbides as possible to precipitate at this stage in this way, the precipitation of additional Cr carbides and the resulting formation of Cr-depleted zones during the subsequent aging (age hardening) treatment can be minimized.

If the aforementioned stabilizing treatment is followed by an inadequate aging (age hardening) treatment, however, the precipitation of additional Cr carbides and the resulting formation of Cr-depleted zones could take place a new, aggravating sulfidation-corrosion resistance of the alloy. The second key point of the present invention is therefore to inhibit the precipitation of Cr carbides by setting age hardening conditions to a lower level than the conventional age hardening conditions.

Taking into account the fact that stabilizing and aging (age hardening) treatment conditions greatly affect the strength properties of alloys, as described earlier, heat treatment conditions according to the present invention were set so as to impart adequate strength properties to the alloy. That is, the heat treatment conditions of the present invention were determined with primary emphasis placed on the corrosion resistance of the alloy while carefully studying the conditions that can also ensure adequate strength, unlike the conventional heat treatment conditions that had placed emphasis on strength alone.

The present invention conceived based on the above considerations is a manufacturing method of a heat-resistant alloy in which the sulfidation-corrosion resistant Ni-based alloy as disclosed in U.S. Pat. No. 5,900,078 containing 0.005 to 0.1% C, 18 to 21% Cr, 12 to 15% Co, 3.5 to 5.0% Mo, not more than 3.25% Ti and 1.2 to 4.0% Al, with the balance substantially consisting of Ni, and other Ni-based alloys, such as Waspaloy, used for members of corrosion-resistant high-temperature equipment are, after solution heat treatment, subjected to stabilizing treatment for 1 to 16 hours at temperatures not lower than 860° C. and not higher than 920° C. and aging (age hardening) treatment for 4 to 48 hours at temperatures not lower than 680° C. and not higher than 760° C. to inhibit the formation of Cr-depleted zones in the vicinity of alloy grain boundaries.

Studies by the present inventor et al. revealed that the formation of Cr-depleted zones due to the precipitation of Cr carbides in alloy grain boundaries is markedly facilitated in a temperature region higher than 760° C. and lower than 860° C. Consequently, the present invention makes it possible to improve the intergranular sulfidation-corrosion resistance of the alloy by intergranular precipitating as much Cr carbides as possible while inhibiting the formation of Cr-depleted zones by subjecting the alloy to stabilizing treatment at a temperature higher than this temperature region, and inhibiting the precipitation of Cr carbides in alloy grain boundaries by subjecting the alloy to aging (age hardening) treatment at a temperature lower than the temperature region.

Stabilizing and aging (age hardening) treatments, on the other hand, have a role of facilitating the precipitation and growth of the γ' phase that contributes to the high-temperature strength of alloys. If the stabilizing treatment temperature is higher than 920° C., however, the γ' phase is markedly coarsened, aggravating the high-temperature strength. Even when stabilizing treatment, is carried out at a temperature not lower than 860° C. and not higher than 920° C. for not longer than 1 hour, then the γ' phase precipitates and grows inadequately, and if the stabilizing treatment time is longer than 16 hours, the γ' phase tends to be coarsened, leading to lowered high-temperature strength. Consequently, stabilizing treatment conditions were specified as a temperature range not lower than 860° C. and not higher than 920° C. for 1 to 16 hours.

As for aging (age hardening) conditions, the γ' phase is precipitated and grown insufficiently, resulting in insufficient high-temperature strength in a temperature region lower than 680° C. Even when the temperature region is in the range of not lower than 680° C. and not higher than 760° C., an aging time shorter than 4 hours would lead to insufficient precipitation and growth of the γ' phase, while an aging time longer than 48 hours would facilitate the precipitation of carbides in alloy grain boundaries. Thus, the aging (age hardening) conditions were specified as follows; an aging temperature not lower than 680° C. and not higher than 760° C. and aging time from 4 to 48 hours.

In the present invention, secondary aging treatment should preferably be performed at a temperature not higher than an aging (age hardening) treatment temperature-20° C. and not lower than 620° C. for not less than 8 hours. In other words, secondary aging (age hardening) treatment should be performed in a temperature range lower than aging (age hardening) treatment temperature.

With this secondary aging (age hardening) treatment, precipitation strengthening by the refined γ' phase can be further facilitated without precipitation of Cr carbides in grain boundaries, thus making it possible to further improve strength without sacrificing sulfidation-corrosion resistance.

A secondary aging (age hardening) treatment temperature lower than 620° C.would hardly precipitate the γ' phase, with little effect of increasing strength, whereas a secondary aging (age hardening) treatment temperature exceeding −20° C. of aging (age hardening) treatment temperature would coarsen the γ' phase precipitated during aging (age hardening) treatment, contributing little to the strength enhancing effect of the precipitation of the refined γ' phase. It is for this reason that the upper-limit of the secondary aging (age hardening) treatment temperature was set to the aging (age hardening) temperature minus 20° C.

Since too short a secondary aging (age hardening) treatment time would reduce the contribution of the precipitation of the refined γ' phase to precipitation strengthening, the secondary aging (age hardening) treatment time was set to not less than 8 hours.

As described in detail in the foregoing, the manufacturing method of a Ni-based alloy according to the present invention can improve the sulfidation-corrosion resistance of the alloy while imparting excellent strength at elevated temperatures to the alloy. In order to give full play to the properties of the alloy, however, it is necessary to optimize the alloy composition needed to improve the sulfidation-corrosion resistance of the alloy itself.

In the following, alloy compositions suitable for use in the present invention will be described. Note that mass percentage is used throughout this Specification unless otherwise specified.

C forms carbides of TiC with Ti, and $M_6C$, $M_7C_3$ and $M_{23}C_6$ types with Cr and Mo. These carbides help inhibit the coarsening of grain sizes. Moreover, $M_6C$ and $M_{23}C_6$ are essential elements for the present invention since they help strengthen grain boundaries as adequate amounts of them are precipitated at the grain boundaries. The above effects, however, cannot be expected if the carbon content is not less than 0.005% of C. C contents over 0.1%, on the other hand, not only reduce the necessary amount of Ti for precipitation hardening, but also excessively increases the Cr carbides precipitated in grain boundaries, thus weakening the grain boundaries and requiring much longer time for precipitating Cr carbides at the grain boundaries and recovering Cr-depleted zones. C was therefore limited to 0.005 to 0.1%.

Cr forms a stable and dense oxide layer, improving oxidation resistance in a corrosive environment where oxidation factors such as atmosphere, oxidizing acids and high-temperature oxidation act simultaneously. When combined with C, Cr precipitates carbides such as $Cr_7C_3$ and $Cr_{23}C_6$, showing the effects of improving elevated-temperature strength. If Cr content is less than 18%, however, oxidation resistance among the aforementioned effects become insufficient, and a Cr content exceeding 21% facilitates the formation of harmful intermetallic compounds, such as the a phase. Cr was therefore limited to 18 to 21%.

Co in a Ni-based alloy itself exists in a solid solution having a matrix strengthening effect, and also has an strengthening effect as it reduces the amount of solid solution of the γ' phase in the Ni-based matrix and increases the amount of γ' precipitation. Co contents less than 12% are insufficient in showing the above effects, while Co contents exceeding 15% may produce harmful intermetallic compounds, such as the a phase, lowering creep strength. Co was therefore limited to 12 to 15%.

Mo which mainly solves the y and γ' phases enhances high-temperature strength, and also serves to improve resistance to corrosion from hydrochloric acid. Mo contents less than 3.5%, however, are insufficient in showing the above effects, while Mo contents exceeding 5.0% destabilize the matrix structure. Mo was therefore limited to 3.5% to 5.0%.

Ti and Al, which form the γ' phase in the form of $Ni_3(Al, Ti)$, are important elements contributing to precipitation hardening. With increasing Ti content, however, sulfidation corrosion in an alloy is facilitated. The upper limit of Ti content was therefore set to 3.25%. The more preferable upper limit of Ti content to inhibit the propagation of sulfidation corrosion is 2.75%. Too low Ti contents, on the other hand, make it difficult to maintain the required high-temperature strength. The Ti content not lower than 0.5% is the minimum level.

When the Ti content is kept within the aforementioned range, an Al content not less than 1.2% must be added in order to maintain high-temperature strength by forming a sufficient amount of the γ' phase. An increase in the Al content is effective in improving not only high-temperature strength but also sulfidation corrosion resistance. Excessive addition of Al, however, could cause small elongation and reduction of area and forgiability at elevated temperatures. The upper limit of Al content was set to 4.0%.

To ensure a balance among high-temperature strength, sulfidation-corrosion resistance, high-temperature ductility and forgeability, the lower limit of Al content should preferably be set to 1.6%. By controlling the Ti and Al contents, high-temperature strength and sulfidation-corrosion resistance can be improved.

In the present invention, any one or both of not more than 0.01% of B and not more than 0.1% of Zr can be contained as an element or elements that are not essential but can inhibit intergranular fracture by increasing the intergranular strength.

If B and Zr are added in quantities exceeding 0.01% and 0.1%, respectively, however, they lower the melting point of grain boundaries, making the alloy vulnerable to melt fracture. The B and Zr contents were therefore limited to not more than 0.01% and not more than 0.1%, respectively.

EXAMPLES

Alloys were manufactured in a vacuum induction furnace, cast in vacuum, and forged into 60×130×1000 mm rectangular billets and 500 mm-diameter or 1400 mm-diameter discs simulating discs of the gas expander turbine, which were used as test specimens. Chemical compositions of the specimens are shown in TABLE 1. Alloy A was an alloy disclosed in U.S. Pat. No. 5,900,078, and Alloy B was an alloy commonly known as Waspaloy.

TABLE 1

| | C | Cr | Co | Mo | Ti | Al | B | Zr | Fe | Si | Mn | S | P | Cu | Bi | Pb | Ni |
|---|---|---|---|---|---|---|---|---|---|---|---|---|---|---|---|---|---|
| | (Mass %) | | | | | | | | | | | | | | | | |
| Alloy A | 0.030 | 19.58 | 13.54 | 4.34 | 1.35 | 3.02 | 0.005 | 0.05 | 0.54 | 0.02 | 0.01 | 0.0005 | 0.002 | 0.01 | 0.2 ppm | 1 ppm | Balance |
| Alloy B | 0.028 | 19.43 | 13.47 | 4.31 | 3.10 | 1.46 | 0.006 | 0.06 | 0.97 | 0.03 | 0.02 | 0.0010 | 0.003 | 0.01 | 0.1 ppm | 2 ppm | Balance |

First, the effects of stabilization treatment temperature and aging (age hardening) treatment temperature, and hold time on sulfidation-corrosion resistance were examined. To this end, an intergranular corrosion region map using Alloy A was prepared to confirm the optimum stabilization treatment temperature and aging (age hardening) treatment temperature, and hold time.

Test specimens used in this test were prepared by sampling Streicher specimens from disc-shaped forgings, which were subjected to heat treatments given in TABLE 2 to examine their respective corrosion weight losses, strength properties and sulfidation-corrosion properties.

TABLE 2

| Conditions | Solution heat treatment conditions | Stabilization treatment or aging treatment conditions |
|---|---|---|
| a | 1040° C. × 4 h air-cooled | 1000° C. × 4 h air-cooled |
| b | 1040° C. × 4 h air-cooled | 1000° C. × 16 h air-cooled |
| c | 1040° C. × 4 h air-cooled | 1040° C. × 48 h air-cooled |
| d | 1040° C. × 4 h air-cooled | 900° C. × 0.5 h air-cooled |
| e | 1040° C. × 4 h air-cooled | 900° C. × 1 h air-cooled |
| f | 1040° C. × 4 h air-cooled | 900° C. × 2 h air-cooled |
| g | 1040° C. × 4 h air-cooled | 900° C. × 4 h air-cooled |
| h | 1040° C. × 4 h air-cooled | 900° C. × 16 h air-cooled |
| i | 1040° C. × 4 h air-cooled | 880° C. × 4 h air-cooled |
| J | 1040° C. × 4 h air-cooled | 843° C. × 0.5 h air-cooled |
| k | 1040° C. × 4 h air-cooled | 843° C. × 1 h air-cooled |
| l | 1040° C. × 4 h air-cooled | 843° C. × 4 h air-cooled |
| m | 1040° C. × 4 h air-cooled | 843° C. × 16 h air-cooled |
| n | 1040° C. × 4 h air-cooled | 843° C. × 48 h air-cooled |
| o | 1040° C. × 4 h air-cooled | 760° C. × 1 h air-cooled |
| p | 1040° C. × 4 h air-cooled | 760° C. × 2 h air-cooled |
| q | 1040° C. × 4 h air-cooled | 760° C. × 4 h air-cooled |
| r | 1040° C. × 4 h air-cooled | 760° C. × 16 h air-cooled |
| s | 1040° C. × 4 h air-cooled | 760° C. × 48 h air-cooled |
| t | 1040° C. × 4 h air-cooled | 730° C. × 16 h air-cooled |
| u | 1040° C. × 4 h air-cooled | 730° C. × 48 h air-cooled |
| v | 1040° C. × 4 h air-cooled | 700° C. × 4 h air-cooled |
| w | 1040° C. × 4 h air-cooled | 700° C. × 16 h air-cooled |
| x | 1040° C. × 4 h air-cooled | 700° C. × 48 h air-cooled |

The Streicher test is designed to examine the degree of the formation of Cr-depleted zones caused by the precipitation of intergranular carbides (susceptibility to intergranular corrosion). As described above, the intergranular sulfidation corrosion put in question here is attributable to the formation of Cr-depleted zones in the vicinity of grain boundaries caused by the precipitation of Cr carbides at grain boundaries. Consequently, the degree of the Cr-depleted zones evaluated in the Streicher test can be considered proportional to intergranular sulfidation-corrosion resistance. This was confirmed by comparing the results of the Streicher tests and hot sulfidation corrosion tests.

FIG. 1 shows an intergranular corrosion region map in which the region of Cr-depleted zone formation is shown by plotting the corrosion weight loss in the Streicher tests with respect to temperature and time.

It is found from FIG. 1 that the temperature zones of the 843° C.×4 h air-cooled stabilization treatment and the 760° C.×16 h air-cooled aging treatment that have been commonly practiced are one of the heat treatment conditions where susceptibility to intergranular corrosion becomes most remarkable, and cannot be regarded as the optimum conditions at least for intergranular sulfidation-corrosion resistance. It is also found that when stabilization treatment in a higher temperature region and aging treatment in a lower temperature region are practiced, susceptibility to intergranular corrosion becomes lower, and intergranular sulfidation-corrosion resistance is improved.

As discussed above, the present invention makes it possible to perform stabilization treatment after solution heat treatment at higher temperatures than with the conventional treatment conditions, and aging treatment at lower temperatures than the conventional conditions, thereby remarkably improving intergranular sulfidation-corrosion resistance.

Based on this knowledge, stabilization treatment temperature, aging (age hardening) treatment temperature, and treatment time were determined. A list of heat treatment conditions applied to Alloys A and B as test specimens is shown in TABLE 3. The alloys shown in the "Alloy" columns in TABLE 3 correspond with those in TABLE 1. TABLE 4 shows the results of sulfidation-corrosion tests and strength tests on alloys to which those heat treatments were applied. The sulfidation-corrosion and strength test specimens used were prepared from samples of the aforementioned rectangular billet and disc-shaped forgings.

Sulfidation-corrosion resistance properties were evaluated based on the presence/absence of fractures and the depth of the resulting intergranular sulfidation corrosion observed by cross-section observation on the test specimens which were subjected to heat treatments given in TABLE 3, and exposed to an $N_2$—3% $H_2$—0.1% $H_2S$ mixed gas atmosphere at 600° C. for 96 hours while exerting a 589 MPa tensile stress as a nominal stress. The strength properties were evaluated based on the tensile properties at room temperature and 538° C., and on creep rupture properties at the temperature of 732° C. and a stress of 518 MPa.

TABLE 3

| Condition | Alloy | Solution heat treatment | Stabilizing treatment | Aging treatment | Secondary aging treatment |
|---|---|---|---|---|---|
| This invention | | | | | |
| 1 | A | 1010° C. × 4 h air-cooled | 880° C. × 4 h air-cooled | 700° C. × 16 h air-cooled | — |
| 2 | A | 1025° C. × 4 h air-cooled | 880° C. × 4 h air-cooled | 700° C. × 16 h air-cooled | — |
| 3 | A | 1040° C. × 4 h air-cooled | 880° C. × 4 h air-cooled | 700° C. × 16 h air-cooled | — |

TABLE 3-continued

| Condition | Alloy | Solution heat treatment | Stabilizing treatment | Aging treatment | Secondary aging treatment |
|---|---|---|---|---|---|
| 4 | A | 1025° C. × 4 h air-cooled | 880° C. × 4 h air-cooled | 700° C. × 16 h air-cooled | 650° C. × 16 h air-cooled |
| 5 | A | 1025° C. × 4 h air-cooled | 880° C. × 4 h air-cooled | 700° C. × 16 h air-cooled | 650° C. × 16 h air-cooled |
| 6 | A | 1025° C. × 4 h air-cooled | 900° C. × 4 h air-cooled | 700° C. × 16 h air-cooled | 650° C. × 16 h air-cooled |
| 7 | A | 1025° C. × 4 h air-cooled | 880° C. × 4 h air-cooled | 730° C. × 16 h air-cooled | 650° C. × 16 h air-cooled |
| 8 | A | 1025° C. × 4 h air-cooled | 880° C. × 4 h air-cooled | 700° C. × 32 h air-cooled | 650° C. × 16 h air-cooled |
| 9 | A | 1025° C. × 4 h air-cooled | 880° C. × 4 h air-cooled | 760° C. × 16 h air-cooled | 650° C. × 16 h air-cooled |
| 10 | B | 1025° C. × 4 h air-cooled | 880° C. × 4 h air-cooled | 700° C. × 16 h air-cooled | — |
| 11 | B | 1040° C. × 4 h air-cooled | 880° C. × 4 h air-cooled | 700° C. × 16 h air-cooled | 650° C. × 16 h air-cooled |
| Comparative example | | | | | |
| 12 | A | 1040° C. × 4 h air-cooled | 843° C. × 4 h air-cooled | 760° C. × 16 h air-cooled | 650° C. × 16 h air-cooled |
| 13 | A | 1040° C. × 4 h air-cooled | 843° C. × 4 h air-cooled | 760° C. × 16 h air-cooled | — |
| 14 | B | 1040° C. × 4 h air-cooled | 843° C. × 4 h air-cooled | 760° C. × 16 h air-cooled | — |

TABLE 4

| | Strength test results | | | | | | | | | | | Hot sulfidation |
|---|---|---|---|---|---|---|---|---|---|---|---|---|
| | Tensile properties at room temperature | | | | Tensile properties at elevated temperature (538° C.) | | | | Creep rupture properties (732° C./518 MPa) | | | corrosion test results Maximum |
| Condition | 0.2% yield strength (MPa) | Tensile strength (MPa) | Elongation (%) | Reduction of area (%) | 0.2% yield strength (MPa) | Tensile strength (MPa) | Elongation (%) | Reduction of area (%) | Break time (h) | Elongation (%) | Reduction of area (%) | intergranular corrosion depth under tensile stress |
| This invention | | | | | | | | | | | | |
| 1 | 894 | 1339 | 26.7 | 30.4 | 834 | 1224 | 21.3 | 25.8 | 47.0 | 16.8 | 32.1 | 12 μm |
| 2 | 874 | 1287 | 25.3 | 29.8 | 801 | 1217 | 22.7 | 30.1 | 58.8 | 17.4 | 24.3 | 18 μm |
| 3 | 852 | 1257 | 29.4 | 34.9 | 764 | 1158 | 24.4 | 33.8 | 73.3 | 15.4 | 29.2 | 21 μm |
| 4 | 885 | 1269 | 25.4 | 30.7 | 781 | 1085 | 24.1 | 25.5 | 66.4 | 21.1 | 24.7 | 24 μm |
| 5 | 838 | 1231 | 27.4 | 33.1 | 765 | 1125 | 22.4 | 31.5 | 51.5 | 24.9 | 34.2 | 28 μm |
| 6 | 870 | 1281 | 26.5 | 35.2 | 759 | 1105 | 24.1 | 27.7 | 76.3 | 28.2 | 36.9 | 15 μm |
| 7 | 874 | 1310 | 23.7 | 27.4 | 792 | 1178 | 20.5 | 18.8 | 101.0 | 36.9 | 61.5 | 30 μm |
| 8 | 884 | 1308 | 25.4 | 29.4 | 801 | 1193 | 26.4 | 33.5 | 118.0 | 25.8 | 34.1 | 27 μm |
| 9 | 866 | 1301 | 24.8 | 29.5 | 789 | 1168 | 21.4 | 35.6 | 94.3 | 30.5 | 41.1 | 29 μm |
| 10 | 877 | 1261 | 21.5 | 28.8 | 799 | 1184 | 23.3 | 34.3 | 75.2 | 22.2 | 25.7 | 13 μm |
| 11 | 862 | 1263 | 24.7 | 30.1 | 773 | 1091 | 21.3 | 29.8 | 122.3 | 13.5 | 18.1 | 17 μm |
| Comparative example | | | | | | | | | | | | |
| 12 | 880 | 1328 | 25.1 | 33.8 | 787 | 1188 | 27.8 | 36.2 | 41.2 | 10.6 | 14.9 | 520 μm |
| 13 | 773 | 1216 | 28.5 | 27.7 | 806 | 1101 | 24.8 | 31.3 | 64.2 | 17.9 | 17.4 | 200 μm |
| 14 | 924 | 1364 | 28.9 | 33.0 | 836 | 1214 | 18.5 | 22.8 | 61.7 | 19.3 | 16.1 | Rupture after 19 h |

It is indicated from the results shown in TABLE 4 that although no appreciable differences were found in strength properties at elevated temperature on any test specimens subjected to any heat treatment conditions, Alloys A and B subjected to conventional heat treatment conditions (Nos. 12, 13 and 14 Conditions) had deep intergranular corrosion of no less than 200 μm under stress load conditions, or could not withstand 96-hour exposure tests to rupture, whereas the maximum intergranular corrosion depth is not more than 30 μm and sulfidation-corrosion resistance was markedly improved with Alloys A and B subjected to heat treatments of this invention (Nos. 1 to 11 Conditions).

Cross-sectional observation results were compared between the test specimens subjected to the heat treatment of the present invention (No. 10 Condition) and the comparative alloys subjected to the conventional heat treatment (No. 14 Condition) that led to rupture. The results are shown in FIG. 2.

Figure 2A:
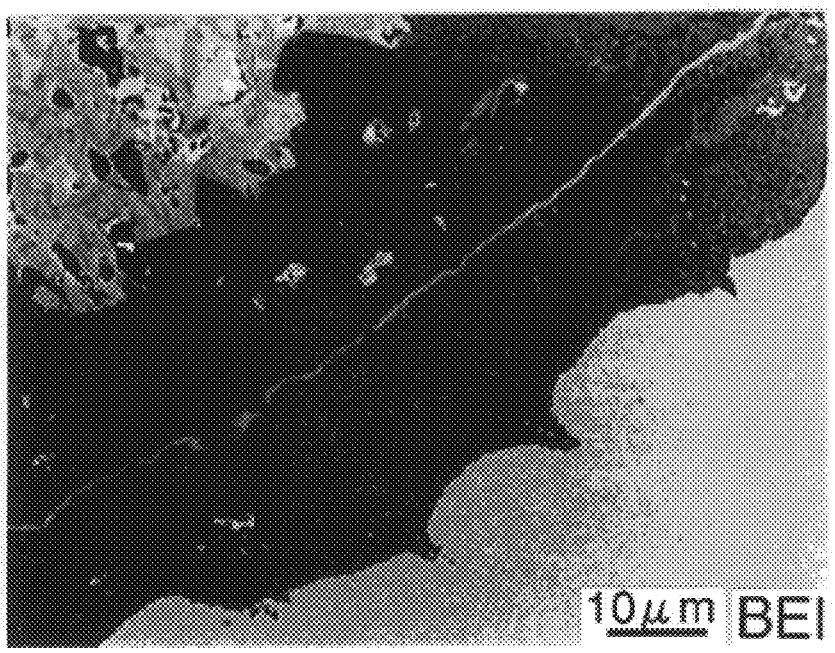
Figure 2B:
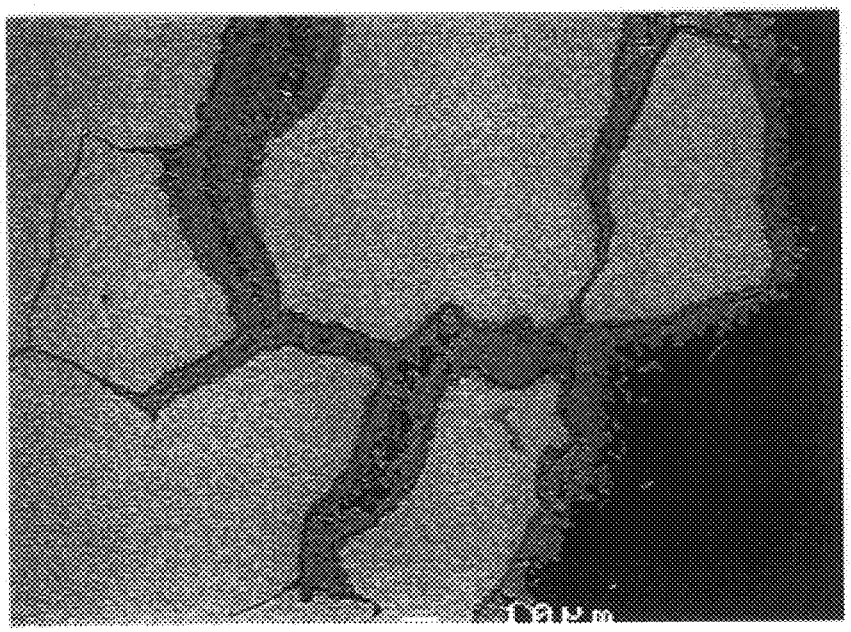

FIG. 2(A) is a cross-sectional metallographical photograph of a test specimen treated under No. 10 Condition according to the present invention in which a white undulated area at the lower right is the alloy base metal. The photo indicates that the intergranular corrosion is shallow in depth. FIG. 2(B), on the other hand, is a cross-sectional metallographical photograph of the fractured part of a test specimen treated under No. 14 Condition. The photo indicates that corrosion developed along grain boundaries, causing severe intergranular sulfidation corrosion. This seems to suggest that a rupture of the alloy is caused by the intergranular sulfidation corrosion.

The above-mentioned test results suggest that hot sulfidation-corrosion resistance can be remarkably improved while maintaining almost the same strength properties at elevated temperature by applying the heat treatment according to the present invention as conventional heat treatment condition to a Ni-based heat-resistant alloy having a particular composition.

As described above, the present invention provides a Ni-based alloy having improved sulfidation-corrosion resistance, particularly intergranular corrosion resistance while maintaining sufficient high-temperature strength properties, compared with conventional heat treatment methods in which emphasis is placed on strength alone. Thus, the present invention can provide equipment components having high reliability in sulfidation corrosive environment.

With the lowering quality of fossil fuel resulting from the needs for reduced loads on the environment and energy conservation, and increased efficiency of energy equipment in recent years, service environments of high-temperature equipment, such as turbines and boilers, are becoming increasingly stringent. Consequently, inventions concerning the improved corrosion resistance of equipment components, such as the present invention, will have great significance in the future.

What is claimed is:

1. A manufacturing method of a Ni-based alloy having improved hot sulfidation-corrosion resistance which alloy consists essentially of, in mass percentage, 0.005 to 0.1% C, 18 to 21% Cr, 12 to 15% Co, 3.5 to 5.0% Mo, not more than 3.25% Ti, and 1.2 to 4.0% Al with the balance substantially comprising Ni, wherein the alloy is, after solution heat treatment, subjected to stabilizing treatment at a temperature not lower than 860° C. and not higher than 920° C. for 1 to 16 hours, and aging treatment at a temperature not lower than 680° C. and not higher than 760° C. for 4 to 48 hours.

2. A manufacturing method of a Ni-based alloy having improved hot sulfidation-corrosion resistance as set forth in claim 1 wherein the alloy contains not more than a 2.75% Ti and 1.6 to 4.0% Al in mass percentages.

3. A manufacturing method of a Ni-based alloy having improved hot sulfidation-corrosion resistance as set forth in claim 2 wherein the alloy contains not more than 0.01% B or not more than 0.1% Zr (in mass percentage).

4. A manufacturing method of a Ni-based alloy having improved hot suffidation-corrosion resistance as set forth in claim 1 wherein the alloy is subjected to secondary aging treatment at a temperature not lower than 620° C. while not higher than the aging treatment temperature minus 20° C. for not less than 8 hours.

5. A manufacturing method of a Ni-based alloy having improved hot sulfidation-corrosion resistance as set forth in claim 4 wherein the alloy contains not more than 2.75% Ti and 1.6 to 4.0% Al in mass percentage.

6. A manufacturing method of a Ni-based alloy having improved hot sulfidation-corrosion resistance as set forth in claim 5 wherein the alloy contains not more than 0.01% B or not more than 0.1% Zr in mass percentage.

* * * * *